US008970335B2

(12) United States Patent
Peck et al.

(10) Patent No.: US 8,970,335 B2
(45) Date of Patent: Mar. 3, 2015

(54) COIL FORM FOR FORMING AN INDUCTIVE ELEMENT

(75) Inventors: Joachim Peck, Soest (DE); Jurgen Pilniak, Warstein/Allagen (DE); Peter Wallmeier, Lippstadt (DE)

(73) Assignee: DET International Holding, Grand Cayman (KY)

( * ) Notice: Subject to any disclaimer, the term of this patent is extended or adjusted under 35 U.S.C. 154(b) by 1040 days.

(21) Appl. No.: 11/661,161

(22) PCT Filed: Aug. 23, 2004

(86) PCT No.: PCT/CH2004/000531

§ 371 (c)(1),
(2), (4) Date: Dec. 5, 2007

(87) PCT Pub. No.: WO2006/021100

PCT Pub. Date: Mar. 2, 2006

(65) Prior Publication Data

US 2008/0252408 A1 Oct. 16, 2008

(51) Int. Cl.

| | |
|---|---|
| ***H01F 27/30*** | (2006.01) |
| ***H01F 27/06*** | (2006.01) |
| ***H01F 27/22*** | (2006.01) |
| ***H01F 27/28*** | (2006.01) |
| ***H01F 41/06*** | (2006.01) |
| *H01F 27/32* | (2006.01) |

(52) U.S. Cl.

CPC ..... *H01F 27/22* (2013.01); *H01F 27/2847* (2013.01); *H01F 41/0687* (2013.01); *H01F 27/323* (2013.01); *H01F 27/324* (2013.01); *H01F 2027/2819* (2013.01); *H01F 2027/2861* (2013.01)

USPC ..... 336/198; 336/65; 336/196; 336/206; 336/207; 336/208

(58) Field of Classification Search

USPC ..... 336/65, 196, 198, 206–208

See application file for complete search history.

(56) References Cited

U.S. PATENT DOCUMENTS

| | | | | | |
|---|---|---|---|---|---|
| 3,244,960 | A | * | 4/1966 | Stevens et al. | 363/126 |
| 4,176,335 | A | * | 11/1979 | Charpentier | 336/180 |
| 4,397,234 | A | * | 8/1983 | Lee et al. | 101/93.29 |
| 4,857,878 | A | * | 8/1989 | Eng et al. | 336/192 |
| 5,398,401 | A | * | 3/1995 | Knight | 29/605 |
| 5,903,202 | A | * | 5/1999 | Endoh et al. | 335/151 |
| 6,160,467 | A | * | 12/2000 | Teimorzadeh et al. | 336/180 |
| 2003/0038700 | A1 | * | 2/2003 | Piechnick | 336/208 |

FOREIGN PATENT DOCUMENTS

| | | |
|---|---|---|
| GB | 864046 | 3/1961 |
| WO | WO 03/030189 A1 | 4/2003 |
| WO | WO 2004/032158 A1 | 4/2004 |

OTHER PUBLICATIONS

IBM (NB80123195), Flight Time Compensation for a Print Hammer, Dec. 1, 1980, IBM Technical Disclosure Bulletin, vol. 23, pp. 3195-3196.*

* cited by examiner

*Primary Examiner* — Tsz Chan

(74) *Attorney, Agent, or Firm* — Vector IP Law Group; Robert S. Babayi

(57) ABSTRACT

The coil form according to the invention for forming an inductive element includes a hollow cylindrical mantle portion, two flange portions and a slit. The flange portions and the mantle portion form a winding chamber for winding therein a wire that forms a first winding or a part of a first winding of the inductive element. The coil form, which is completely made of copper, forms a second coil or a winding of a second coil of the inductive element. Due to the increased contact surface between the first and the second coil the heat dissipation capabilities and the magnetic coupling between the coils are increased. This in turn results in an increased power density of the inductive element.

2 Claims, 2 Drawing Sheets

COIL FORM FOR FORMING AN INDUCTIVE ELEMENT

CROSS REFERENCE TO RELATED APPLICATIONS

This application is a National Stage application of the Patent Cooperation Treaty Application No. PCT/CH2004/000531 filed on Aug. 23, 2004, from which priority is claimed.

TECHNICAL FIELD

The invention relates to a coil form for forming an inductive element with a core, a first coil and a second coil, where the coil form is built such that the first coil can be wound around the coil form. The invention further relates to a corresponding inductive element and a method for forming such an inductive element.

BACKGROUND ART

In the manufacturing of electric and/or electronic components such as for example inductive elements like transformers, inductors or chokes, there exists an ongoing demand for devices with higher power density. However, the higher the power density of an inductive element, the lower the total losses that need to be dissipated by a smaller surface of the inductive element in order to keep the temperature rise constant. Contrary, in order to fulfill the regulations and safety requirements, insulation distances have to be increased and insulators between the coils and the core like for example plastic coil formers have to be inserted. These plastic coil formers reduce the copper fill factor, that is the ratio of the utilized and the available winding window. Therefore, the nonconductive areas typically restrict the reduction of the losses in the inductive elements.

In order to provide transformers with higher copper fill factors and lower winding losses that require only a small space, planar transformers where the windings are formed by copper traces that are etched on a printed circuit board (PCB), have been introduced. However, the copper fill factors of PCB planar transformers are limited to a certain extent. In order to carry high currents, several PCB's have to be paralleled because the thickness of the traces that can be etched on a PCB is limited. Hence, these PCB's increase the insulation space causing a low copper fill factor. Finally, they are not useful in other applications such as for example in high power, high current applications.

The document WO 03/030189 A1 shows a transformer for high power applications with enhanced quality and safety standards. Here, the primary windings are formed by a wire that is wound around a plastic bobbin, while the secondary winding is formed by at least one metal sheet that is open on one side, plugged onto the bobbin and connected to a printed circuit board.

This transformer is able to carry high currents and allows copper fill factors that are higher compared to PCB planar transformers. However, this transformer has a plastic bobbin that limits the copper fill factor tremendously and therefore has degraded electrical and/or magnetic characteristics.

SUMMARY OF THE INVENTION

It is the object of the invention to create a coil form pertaining to the technical field initially mentioned, that avoids the disadvantages of the prior art and particularly enables the manufacturing of inductive elements with an improved power density.

The solution of the invention is specified by the features of claim 1. According to the invention, the coil form is completely made of an electrically conducting material and forms a winding of the second coil of the inductive element.

Manufacturing the coil form completely from an electrically conducting material and using the coil form itself as a winding of the inductive element has several advantages over the prior art. First of all, the inductive element has a very high copper fill factor and therefore reduced losses. Additionally, the electrically conducting material typically conducts heat better than a coil form made of plastic. In comparison with a corresponding prior art bobbin with a plastic coil body, the coil form according to the invention further also has a larger surface to dissipate the heat.

Directly using the coil form as a winding of the inductive element further results in decreased losses and enhanced magnetic coupling and therefore in an increased power density of the inductive element.

Since only one sort of material is necessary to manufacture the coil form, the manufacturing process can be simplified and therefore, the manufacturing costs can be reduced.

Furthermore, it is possible to reduce the usage of certain environmentally hazardous substances such as for example flame retardants as often used in plastic coil forms. The invention also enables an easier recycling and/or waste disposal of disused inductive components because an inductive element with a coil form according to the invention that does not include plastic is easier to disassemble and to dispose than a prior art coil form that does include plastic.

Generally, every electrically conducting material such as conductors and also semiconductors may be used for the coil form. However, the higher the electric conductivity of the used material is, the better is the performance of the resulting inductive element. Therefore, the coil form is advantageously made of a metal such as for example silver, copper, gold, aluminum or the like with a high electric conductivity. Because of its good availability and its low price, copper is typically used for manufacturing the coil form.

The inductive element to be formed with the coil form includes some kind of magnetic storage element. Preferably, the invention is used for forming a transformer with a magnetic core such as for example a ferrite core. Hence, the coil form preferably includes an opening for insertion of the core such that the coil form at least partially encompasses the core for inducing a current in the coil form when a magnetic flux is flowing within the core or for generating a magnetic flux within the core when a current is flowing through the coil form.

In order to prohibit short circuits and leakage currents, the coil form is built such that no closed current path around its opening exists. The coil form advantageously includes a slit that typically leads from the opening of the coil form to its outer edge thereby interrupting any closed current path within the coil form around its opening.

The coil form can be of any suitable shape. There does not exist any predetermined, mandatory shape for the coil form. However, some shapes are suited better than others. In order for example to facilitate the manufacturing of the coil form and/or the following processing to produce an inductive element, coil forms that include a substantially cylindrical mantle portion and two flange portions are preferred. The mantle portion has a hollow, cylindrical shape and the flange portions are provided at both ends of the mantle portion such that the mantle portion and the flange portions form a winding chamber. In the winding chamber, a wire can be wound to form another coil or a part of another coil of the inductive element.

The width and height of the winding chamber, that is, the size and the shape of the flange portions, as well as the diameter and the length of the mantle portion, are chosen according to the requirements of the specific application. It is to note that the maximum number of windings within the winding chamber not only depends on the dimensions of the winding chamber, but also on the used wire.

Generally, the cylindrical mantle portion can be of the kind of a right or oblique cylinder where the base of the cylindrical mantle portion can be of any desired shape such as for example rectangular, square, elliptic, triangular or any other shape. Nevertheless, a mantle portion with a hollow, right cylindrical shape having a circular base is preferred. In this case each flange portion defines and lies in a plane perpendicular to the axis of the cylindrical mantle portion, each at one end of the mantle portion. In other words, the flange portions are peripheral walls at both ends of the mantle portion, protruding perpendicularly outward from the outer surface of the mantle portion.

The coil form can be manufactured as a one-piece device for example by injection molding or any other suitable forming or chip removing material processing such as milling, turning and drilling.

In a preferred embodiment of the invention, the coil form includes at least two elements that are fitted together. With respect to the electrical characteristics, it is irrelevant how the coil form is subdivided into these elements. However, for a more efficient manufacturing process, the coil form is divided into said at least two elements by a plane that is substantially parallel to said flange portions. In the case of a right cylindrical, circular mantle portion, this is a plane that is perpendicular to the axis of the mantle portion. In a most preferred embodiment, the coil form includes two such elements fitted together to form the coil form, each element including a part of the mantle portion and one flange portion.

For producing the coil form, first the elements are fabricated separately. This can for example be done by punching, laser-cutting, water-cutting or in any other known way. And then the single elements are fitted together to form the coil form. This can for example be done by soldering, gluing, lasering, welding, press-fitting or the like.

Since the coil form forms a winding of a coil of an inductive element, it has to be electrically conductively connected to an electric circuit, for example to a rectifier circuit of a power converter. Although such connections can be implemented in any suitable way, for example by connecting wires to the mantle or flange portions of the coil form, the coil form advantageously includes two or more terminals for connecting it to an electric circuit.

The terminals are for example adapted to fit into corresponding recesses in a printed circuit board that carries the electric circuit or a part of it.

An inductive element according to the invention, for example a power transformer, includes at least one coil form as described above that forms a winding of one coil of the inductive element. The inductive element also includes a further coil that is formed by at least one wire wound around the at least one coil form.

It is possible to use the coil form as a primary winding and the wire wound around the coil form as a secondary winding of a transformer. However, a power transformer typically has more windings on the primary side than on the secondary side wherefore the current in the secondary windings is higher than in the primary windings. It is therefore preferred that the coil form forms a winding of a secondary coil and the wire forms a primary coil or a part of a primary coil of the inductive element.

Generally, any insulated wire can be used to form the primary coil. But since the wire is wound directly on the coil form, which means that the primary coil is in direct contact with the secondary coil, a highly insulated wire should be used to fulfill the high voltage requirements in high current applications. Preferably, a triple insulated wire as known in the art is used as the primary winding.

In accordance with the invention, a method for forming an inductive element with a coil form, a core, and a plurality of coils includes the following steps:

Providing a winding or windings of one of the plurality of coils by winding a wire around the coil form.

Providing a winding or windings of a further of the plurality of coils by manufacturing the coil form from an electrically conducting material and utilizing said coil form as said winding of the further of the plurality of coils.

Inserting the core into an opening of the coil form.

The inductive element can then be connected to a primary and secondary circuit of a power converter.

Other advantageous embodiments and combinations of features come out from the detailed description below and the totality of the claims.

BRIEF DESCRIPTION OF THE DRAWINGS

The drawings used to explain the embodiments show.

In the figures, the same components are given the same reference numbers.

PREFERRED EMBODIMENTS

Figure 1:
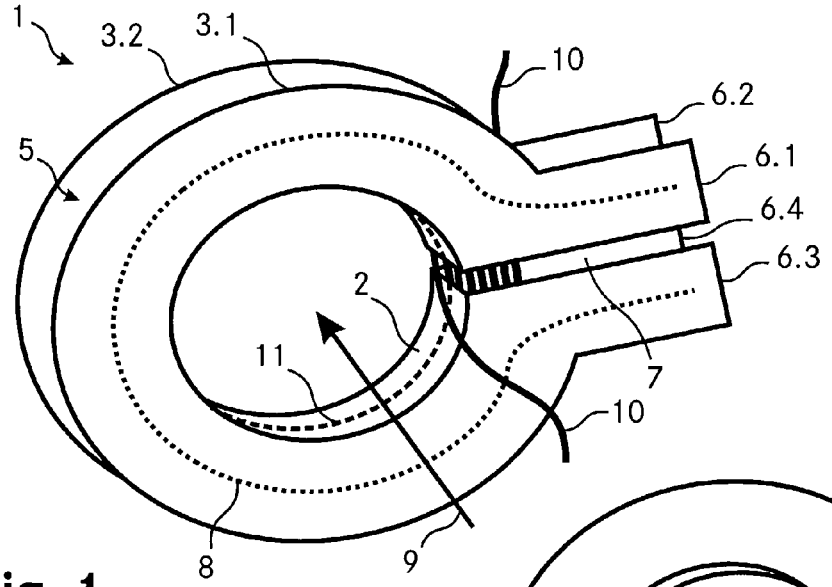
FIG. 1 A schematic, perspective view of a coil form according to the invention.

FIG. 1 shows a coil form 1 according to the invention. The coil form includes a hollow, cylindrical mantle portion 2 and two ring-shaped flange portions 3.1, 3.2 at both ends of the mantle portion 2. The mantle portion 2 and the flange portions 3.1, 3.2 are made of copper. The mantle portion 2 forms an opening 9 where a magnetic core can be inserted. The outer surface of the mantle portion 2 and the inner side walls of the flange portions 3.1, 3.2 form a winding chamber 5. On the right side of the coil form 1 (as shown in the drawing), the coil form 1 includes four terminals 6.1, 6.2, 6.3, 6.4. A slit 7 divides the mantle portion 2, the flange portions 3.1, 3.2 and the terminals 6.1, 6.2, 6.3, 6.4 such that a current path 8 is formed around the opening 9. For example, a current running along the current path 8 counter clockwise first flows through the terminals 6.1 and 6.2, then through the flange portions 3.1, 3.2 and the mantle portion 2 and then through the terminals 6.3 and 6.4. The slit 7 prohibits an electrical connection between the terminals 6.1, 6.2 and the terminals 6.3, 6.4 other than the electrical connection along the current path 8.

Within the winding chamber 5, a wire 10 is wound around the mantle portion 2 several times. In the example shown, one end of the wire 10 leaves the winding chamber 5 through the slit 7 while the other end of the wire 10 leaves the winding chamber 5 somewhere on its outer surface. Here, the wire 10 has for example been thread through the slit 7 and then wound around the mantle portion 2. There exist other winding techniques where both ends of the wire leave the winding chamber at the same position.

When a magnetic core is inserted into the opening 9, current path 8 forms a winding of a one coil around the magnetic core and the wire 10 forms another coil or a part of another coil around the magnetic core. The coil form 1 is connected to an electric/electronic circuit by means of its terminals 6.1, 6.2, 6.3, 6.4. Accordingly, the ends of the wire 10 are also connected to an electric/electronic circuit.

Figure 2:
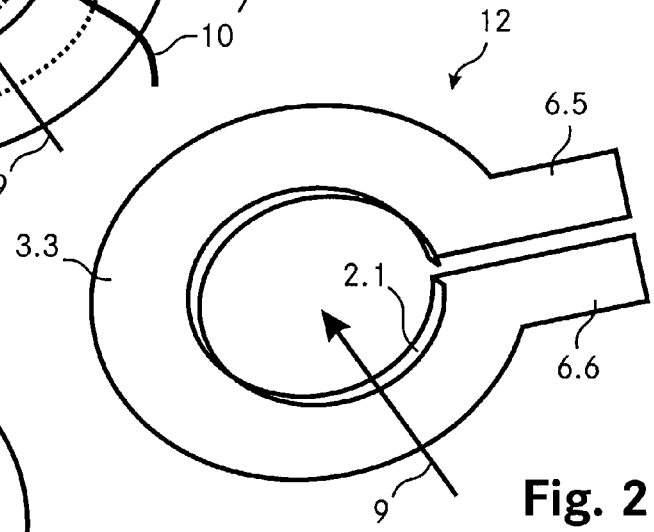
FIG. 2 a schematic, perspective view of a coil form element for forming the coil form shown in FIG. 1.

The coil form 1 shown in FIG. 1 need not be one-piece. It can be composed of two identical elements. Such a coil form element 12 is shown in FIG. 2. The coil form element 12 includes two terminals 6.5, 6.6, a flange portion 3.3 and about one half 2.1 of the mantle portion 2. The coil form element 12 is for example produced by punching it out of a copper sheet and bending the inner edge of the opening 9 to form the half 2.1 of the mantle portion 2.

Two of these coil form elements 12 are then fitted together for example by soldering. The joint that is generated when the two coil form elements 12 are soldered together is shown as the dashed line 11 in FIG. 1.

Figure 3:
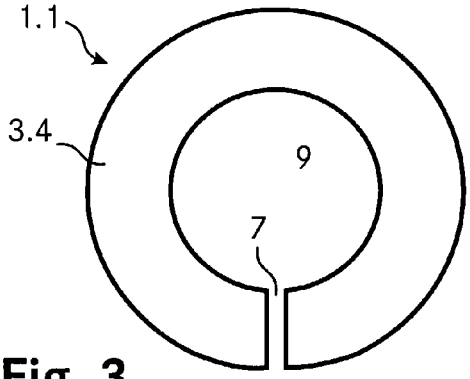
FIG. 3 a top view of another coil form according to the invention.
Figure 4:
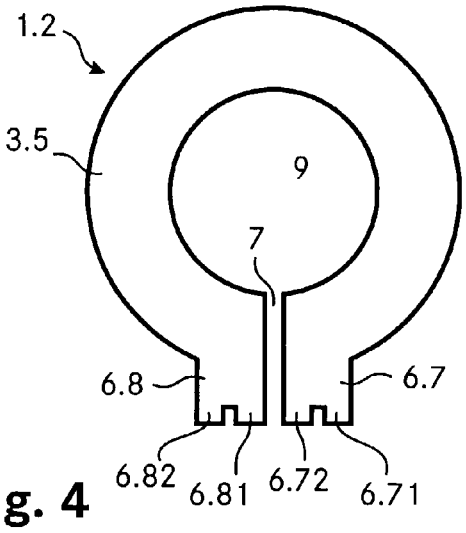
FIG. 4 a top view of a further coil form according to the invention.
Figure 5:
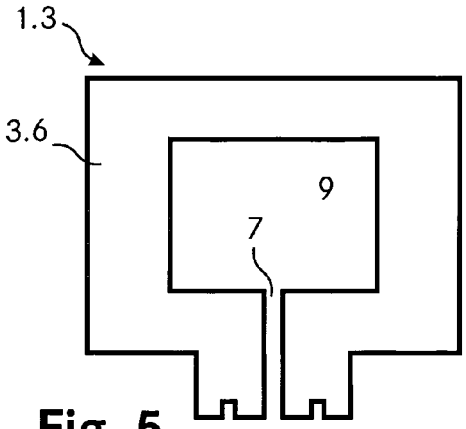
FIG. 5 a top view of yet another coil form according to the invention.

FIG. 3 to 5 show top views of other embodiments of a coil form according to the invention. Coil form 1.1 shown in FIG. 3 has ring-shaped flange portions around a circular opening 9. Because of the top view, only one flange portion 3.4 interrupted by the slit 7 is visible. The coil form 1.1 has no separate terminals. It is for example connected to an electric/electronic circuit by soldering wires to one or both flange portions on either side of the slit 7.

FIG. 4 shows another coil form 1.2 according to the invention. The coil form 1.2 also has ring-shaped flange portions with only the upper flange portion 3.5 with modified terminals 6.7, 6.8 being visible. Each terminal 6.7, 6.8 is divided into two sections 6.71, 6.72 and 6.81, 6.82. The coil form 1.2 is for example connected to an electric/electronic circuit that is implemented on a printed circuit board (PCB, not shown). The coil form 1.2 is fitted to the PCB by inserting each section 6.71, 6.72 and 6.81, 6.82 into a corresponding recess in the PCB. By dividing each terminal 6.7, 6.8 into two sections 6.71, 6.72 and 6.81, 6.82, the mechanical stability is increased, when the coil form is fitted to the PCB. The electrical connections between the sections 6.71, 6.72 and 6.81, 6.82 and the electric/electronic circuit on the PCB are then for example realized by copper traces on the surface of the PCB or on inner layers of a multilayer PCB.

FIG. 5 shows a further coil form 1.3 according to the invention. Again, only the upper flange portion 3.6 of the coil form 1.3 is visible. While the flange portions and the mantle portions of the examples shown in FIG. 1 to 4 define a circular opening 9 for the magnetic core, the flange portion 3.6 and the mantle portion (not visible) in this case has a rectangular shape enclosing a rectangular opening 9. Such a coil form is best suited for insertion of a magnetic core with a corresponding rectangular cross section.

Figure 6:
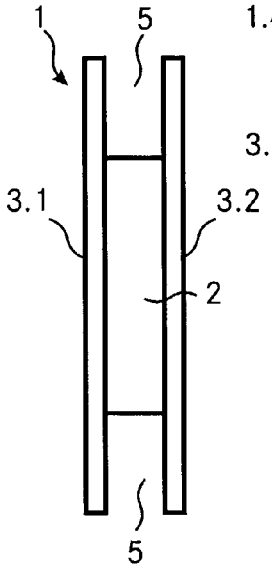
FIG. 6 a side view of the coil form shown in FIG. 1.
Figure 7:
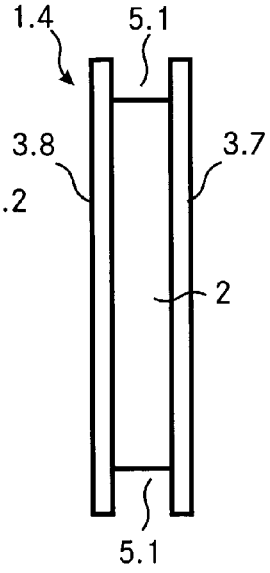
FIG. 7 a side view of another coil form according to the invention.
Figure 8:
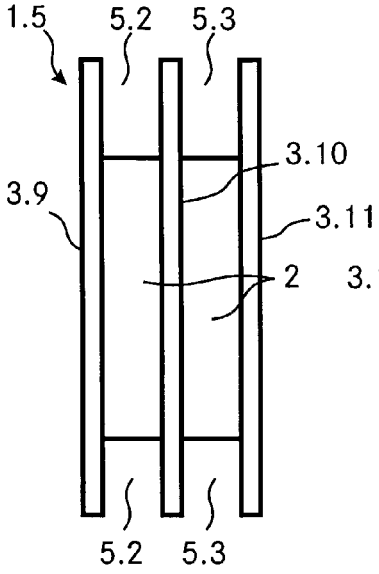
FIG. 8 a side view of further coil form according to the invention.

FIGS. 6, 7 and 8 show side views of different embodiments of a coil form according to the invention. FIG. 6 shows a side view of the coil form 1 shown in FIG. 1 with the mantle portion 2, the flange portions 3.1, 3.2 and the resulting winding chamber 5 (the terminals not being visible).

FIG. 7 shows a coil form 1.4 where the mantle portion 2 has a larger diameter then the mantle portion 2 of the coil form shown in FIG. 6. Therefore, the resulting winding chamber 5.1 is smaller, that is less deep, then the winding chamber 5 of the coil form of FIG. 6.

FIG. 8 shows a coil form 1.5 with three flange portions 3.9, 3.10, 3.11. The flange portions 3.9, 3.11 are provided at the ends of the mantle portion 2 and the flange portion 3.10 is provided between the other flange portions 3.9, 3.11, for example at the middle of the mantle portion 2, such that two winding chambers 5.2, 5.3 are formed. The first winding chamber 5.2 is formed between the flange portions 3.9 and 3.10 and the second winding chamber 5.3 is formed between the flange portions 3.10 and 3.11. In this manner, coil forms with a plurality of flange portions and therefore with a plurality of winding chambers may be formed. In each winding chamber, a separate wire may be wound. However, the wires may form separate coils or the wires may be connected to form a single coil with a higher number of turns.

Figure 9:
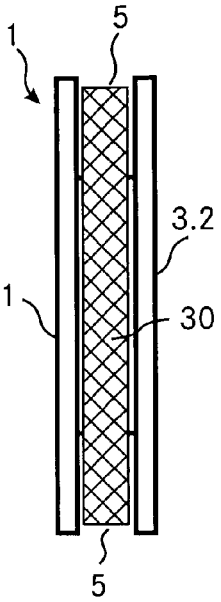
FIG. 9 a side view of yet another coil form according to the invention.

FIG. 9 shows the coil form 1 from FIG. 6 having a wire winding 30 wound within the winding chamber 5 on the outer surface of the mantle portion 2. The number of windings of the wire winding 30 is chosen to fulfill the requirements of the specific application.

The wire may for example be a triple insulated wire, that is a wire with two to three insulation layers such as for example polyimide or polyamide foils. Other electrically isolating materials like fluoroplastics such as for example PTFE (polytetrafluoroethylene) or PFA (polyfluoroalkoxy) are also suitable for producing isolated wires.

It is to note that for reasons of clarity the wire winding 30 is shown to have a particular clearance to the flange portions 3.1, 3.2. However, the wire winding 30 typically is in direct contact with the flange portions 3.1, 3.2 such as to enable an efficient heat transfer between the wire of the wire winding 30 and the coil form 1 and therefore an efficient cooling of a corresponding transformer arrangement.

Typically, the magnetic core for use in an inductive element according to the invention is formed by two or more core elements. The core elements are fitted together whereas at least one leg of one core element is inserted into the opening of the coil form such that the coil form at least partially encompasses the core for inducing a current in the coil form when a magnetic flux is flowing within the core or for generating a magnetic flux within the core when a current is flowing through the coil form.

Figure 10:
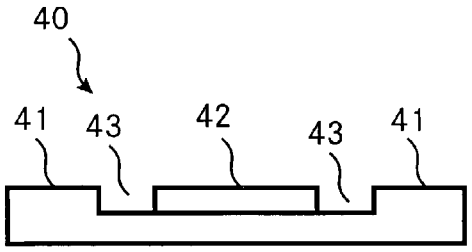
FIG. 10 a front view of a core element for forming an inductive element according to the invention.
Figure 11:
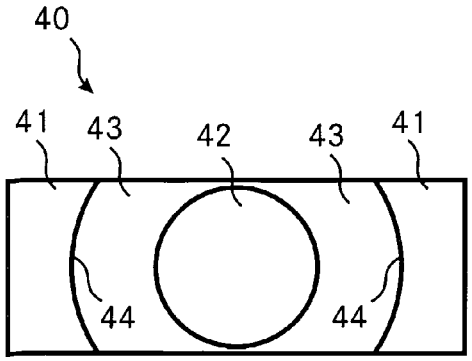
FIG. 11 a top view of the core element shown in FIG. 10.

FIGS. 10 and 11 show a core element 40 where a side view of the core element 40 is given in FIG. 10 and a top view in FIG. 11. The core element 40 is an E-type core element with two outer legs 41 and a center leg 42. Two core elements 40 are fitted together to build up a magnetic core with the shape of an 8 for forming an inductive element according to the invention. However, it is self-evident, that any other magnetic core with a suitable shape, for example with an O-shape, can be used to form an inductive element according to the invention. Also, a magnetic core can be made up of different core elements such as for example an E-shaped core element and an I-shaped core element to form a magnetic core with the shape of an 8.

The shape of the core element 40, particularly the shape of the outer legs 41 and the center leg 42 is chosen such that it matches the shape of the coil form in use. In the case of a coil form as shown in FIG. 1, the center leg 42 has a circular cross-section and the outer legs 41 have a substantially rectangular cross-section with a concave edge 44. The interspace 43 between the center leg 42 and the outer legs 41 form a ring-shaped cut-out area that matches the ring-shaped coil form 1.

In order to form a magnetic element according to the invention having a coil form, a core, a first coil and a second coil, the following steps have to be carried out:

a) Manufacturing the coil form, for example the coil form 1 as shown in FIG. 1, from an electrically conducting material such as for example copper;

b) providing a winding of one coil by utilizing the coil form 1 as a winding;

c) providing a further coil by winding a wire 10 around the coil form 1;

d) providing a magnetic core for example by providing two core elements 40 as shown in FIGS. 10 and 11 and e) inserting the magnetic core, that is the center legs 42 of both core elements 40, into the opening 9 of the coil form 1 and fitting the core elements 40 together.

Preferably, the core elements 40 are fitted together, for example by bonding, gluing, clamping or the like.

Figure 12:
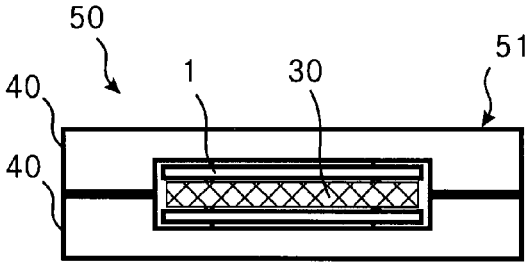
FIG. 12 an inductive element according to the invention.

FIG. 12 shows an inductive element 50 according to the invention. The inductive element 50 includes two core elements 40 to form a magnetic core 51. The inductive element 50 further includes a coil form 1 as shown in FIG. 6 having a wire winding 30 wound around its mantle portion such as shown in FIG. 9. The center legs of the core elements 40 are inserted into the opening 9 of the coil form 1.

In a preferred application of the invention, the inductive element 50 is used as a transformer in a power converter. The wire winding 30 is the primary coil or, in the case of multiple primary coils, one of the primary coils of the transformer and the coil form 1 is the only winding or, in the case of multiple windings, one of the windings of a secondary coil of the transformer. The wire winding 30 and the coil form 1 are connected to an associated electric and/or electronic circuit as described above.

Figure 13:
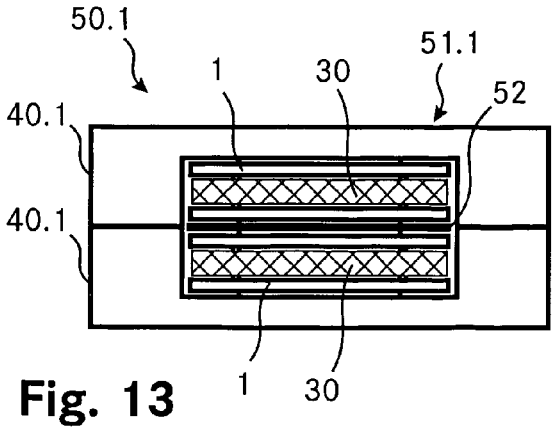
FIG. 13 another inductive element according to the invention.

FIG. 13 shows a further embodiment of an inductive element 50.1 according to the invention. The inductive element 50.1 includes two E-shaped core elements 40.1 that form a magnetic core 51.1 with longer legs than the magnetic core 51 of the inductive element 50 shown in FIG. 12.

The inductive element 50.1 further includes two coil forms 1, each having a wire winding 30 wound around its mantle portion. The coil forms 1 are stacked one upon the other and the center leg of the magnetic core 51.1 is inserted into the openings 9 of the coil forms 1 which are arranged to form one single cylindrical opening. In the example shown, an insulation layer 52 which also includes an opening for insertion of the core, is inserted between the coil forms 1. Therefore, the coil forms 1 form two different windings of one secondary coil or two secondary coils of a transformer. If these two windings are part of the same secondary coil, they can either be connected serially to form a coil with two windings around the center leg of the magnetic core 51.1 or they can be connected in parallel to form a single winding with a doubled current conducting capacity.

If both coil forms 1 are connected in parallel, the insulation layer 52 can also be omitted. Such an arrangement substantially corresponds to a transformer arrangement with the coil form 1.5 as shown in FIG. 8.

In summary, it is to be noted that the invention enables a simplified manufacturing of inductive elements. Since the coil also serves as a coil of the inductive element, the step of providing a separate coil can be omitted. Because of the enhanced magnetic coupling, an inductive element according to the invention furthermore shows an increased power density.

The foregoing descriptions of at least one preferred embodiment are exemplary and not intended to limit the claimed invention. Obvious modifications that do not depart from the spirit and scope of the invention as claimed will be apparent to those skilled in the art.

The invention claimed is:

1. A coil form for forming an inductive element with a core, a first coil having a first pair of terminals and a second coil having a second pair of terminals, wherein the coil form is completely made of an electrically conducting material and comprises a metallic mantel portion formed around a mantel axis having a metallic base and two metallic flange portions at each end of the mantel portion, said two metallic flange portions being on a plane that is substantially perpendicular to the mantel axis such that the metallic mantel portion and the two metallic flange portions form a winding chamber around the metallic base of the metallic mantel portion, wherein the first coil comprises insulated wire wound on top of the metallic base within the winding chamber, the coil form forming a winding of said second coil by providing a current path between the second pair of terminals, wherein the first coil and the second coil comprise a transformer having magnetically coupled windings, and wherein the first pair of terminals electrically connect the first coil to a first electrical circuit and the second pair of terminals electrically connect the coil form to a second electric circuit.

2. The coil form according to claim 1, the coil form further including at least two elements that are fitted together.

* * * * *